US006279867B1

(12) United States Patent
Knarr

(10) Patent No.: US 6,279,867 B1
(45) Date of Patent: Aug. 28, 2001

(54) MULTI-PART FORM OF A MOLD FOR FORMING A CONTAINMENT MEMBER FOR MOLTEN METAL

(75) Inventor: R. Scott Knarr, Chesterton, IN (US)

(73) Assignee: Magneco/Metal, Inc., Addison, IL (US)

( * ) Notice: Subject to any disclaimer, the term of this patent is extended or adjusted under 35 U.S.C. 154(b) by 0 days.

(21) Appl. No.: 09/250,444

(22) Filed: Feb. 16, 1999

(51) Int. Cl.[7] ..... B28B 7/34

(52) U.S. Cl. ..... 249/62; 249/175; 249/178; 249/184; 249/144; 249/152

(58) Field of Search ..... 164/47, 271, 418; 249/62, 175, 178, 184, 144, 152

(56) References Cited

U.S. PATENT DOCUMENTS

| | | | | |
|---|---|---|---|---|
| 3,671,204 | * | 6/1972 | Foley et al. | 164/47 |
| 5,259,442 | * | 11/1993 | Clark | 164/47 |
| 5,482,248 | * | 1/1996 | Connors, Jr. | 249/62 |
| 5,511,762 | * | 4/1996 | Connors, Jr. et al. | 249/115 |

* cited by examiner

*Primary Examiner*—Nam Nguyen
*Assistant Examiner*—I.-H. Lin
(74) *Attorney, Agent, or Firm*—Brinks Hofer Gilson & Lione

(57) ABSTRACT

The present invention is directed to a multi-part form, for use in forming an inner wall of a mold. The multi-part form includes a consumable exterior wall for contacting a casting compound. A collapsible intermediate wall contacts an inner side of the exterior wall and an interior wall is slidably engaged with the intermediate wall. The present invention is also directed to a method of forming a containment member for molten metal. A mold having an inner wall is provided. The inner wall includes a consumable exterior wall for contacting a casting compound, a collapsible intermediate wall that contacts an inner side of the exterior wall and an interior wall that is slidably engaged with the intermediate wall. Also provided is an outer wall that substantially surrounds the inner wall and defines a space between the outer wall and the inner wall. Casting compound is poured into the space and the casting compound is allowed to set. The interior wall is removed from the inner wall, the intermediate wall is collapsed and the intermediate wall is removed from the inner wall.

15 Claims, 5 Drawing Sheets

MULTI-PART FORM OF A MOLD FOR FORMING A CONTAINMENT MEMBER FOR MOLTEN METAL

FIELD OF THE INVENTION

The present invention relates generally to the field of molds for containment members used for containing and processing molten material and, in particular, to a multi-part form that is used as the inner wall for such a mold.

BACKGROUND OF THE INVENTION

This invention relates to a method of and structure of manufacturing open top, walled members such as troughs, runners, ladles and other vessels which are used for containing and processing molten iron and steel. It is well known in the art that such open, top walled members may have sufficient structural integrity to support alone molten metal poured therein.

Conventionally, troughs and runners for transporting molten iron and steel are constructed in situ near a tap spout of a blast furnace or other molten metal container. The mold for the trough or runner utilizes the existing walls of a trench or other existing structure as the outer (lower) walls of the mold. The inner (upper) walls of such molds have conventionally been formed of heavy steel plates spaced from the outer walls leaving only an open space between the outer and inner mold walls in which to pour the casting compound and to provide a venting area for the release of moisture during setting of the casting compound. In the past, heavy oil or grease was placed on the sides of the inner walls facing the outer walls to allow for more ease in the removal of the inner wall from the casting compound.

Inner walls of molds have also been made of a consumable, open mesh, galvanized steel screen. Typically, there are adequate openings in the mesh screen to permit venting of moisture from the drying compound. The mesh screen is not removed and is melted by the molten metal being introduced into the finished trough or runner.

In some instance it is desired to use the mesh screen a multiple number of times for the formation of other troughs or runners. This provides a savings in cost by preserving the screen material. Manufacturing time is reduced by forming a multiple number of identical troughs or runners from a single mesh screen instead of creating a mesh screen for each trough or runner. This also provides a consistency in the quality of each trough or runner.

In the past, when reusing the mesh screen for forming additional containment members, the casting compound would often stick to the screen. Chunks of the casting compound would be removed along with the screen when the screen was lifted from the mold. Also, the casting compound would ooze through holes in the screen and stick to framework provided to support the screen. This required a greater amount of time and effort to remove the screen.

Accordingly it would be desirable to have a form which overcomes the disadvantages described above, is reusable and can be efficiently and quickly removed from the mold.

BRIEF SUMMARY OF THE INVENTION

One aspect of the invention provides a multi-part form, for use in forming an inner wall of a mold. The multi-part form includes a consumable exterior wall for contacting a casting compound. A collapsible intermediate wall contacts an inner side of the exterior wall and an interior wall is slidably engaged with the intermediate wall.

Another aspect of the invention provides a method of forming a containment member for molten metal. A mold having an inner wall is provided. The inner wall includes a consumable exterior wall for contacting a casting compound, a collapsible intermediate wall that contacts an inner side of the exterior wall and an interior wall that is slidably engaged with the intermediate wall. Also provided is an outer wall that substantially surrounds the inner wall and defines a space between the outer wall and the inner wall. Casting compound is poured into the space and the casting compound is allowed to set. The interior wall is removed from the inner wall, the intermediate wall is collapsed and the intermediate wall is removed from the inner wall.

The invention provides the foregoing and other features, and the advantages of the invention will become further apparent from the following detailed description of the presently preferred embodiments, read in conjunction with the accompanying drawings. The detailed description and drawings are merely illustrative of the invention and do not limit the scope of the invention, which is defined by the appended claims and equivalents thereof.

DETAILED DESCRIPTION OF THE INVENTION

FIGS. 1–8 of the drawings show a method of manufacture of an open top, walled structure such as a trough or runner which is used as a containment member to transfer molten metal, such as iron and steel, from a source of molten metal such as the tap hole of a blast furnace or converter. The trough of the present embodiment may be similar or identical to the troughs disclosed in U.S. Pat. Nos. 5,511,162; 5,482,248 and 5,505,893, the entire disclosures of which are hereby incorporated by reference.

Figure 1:
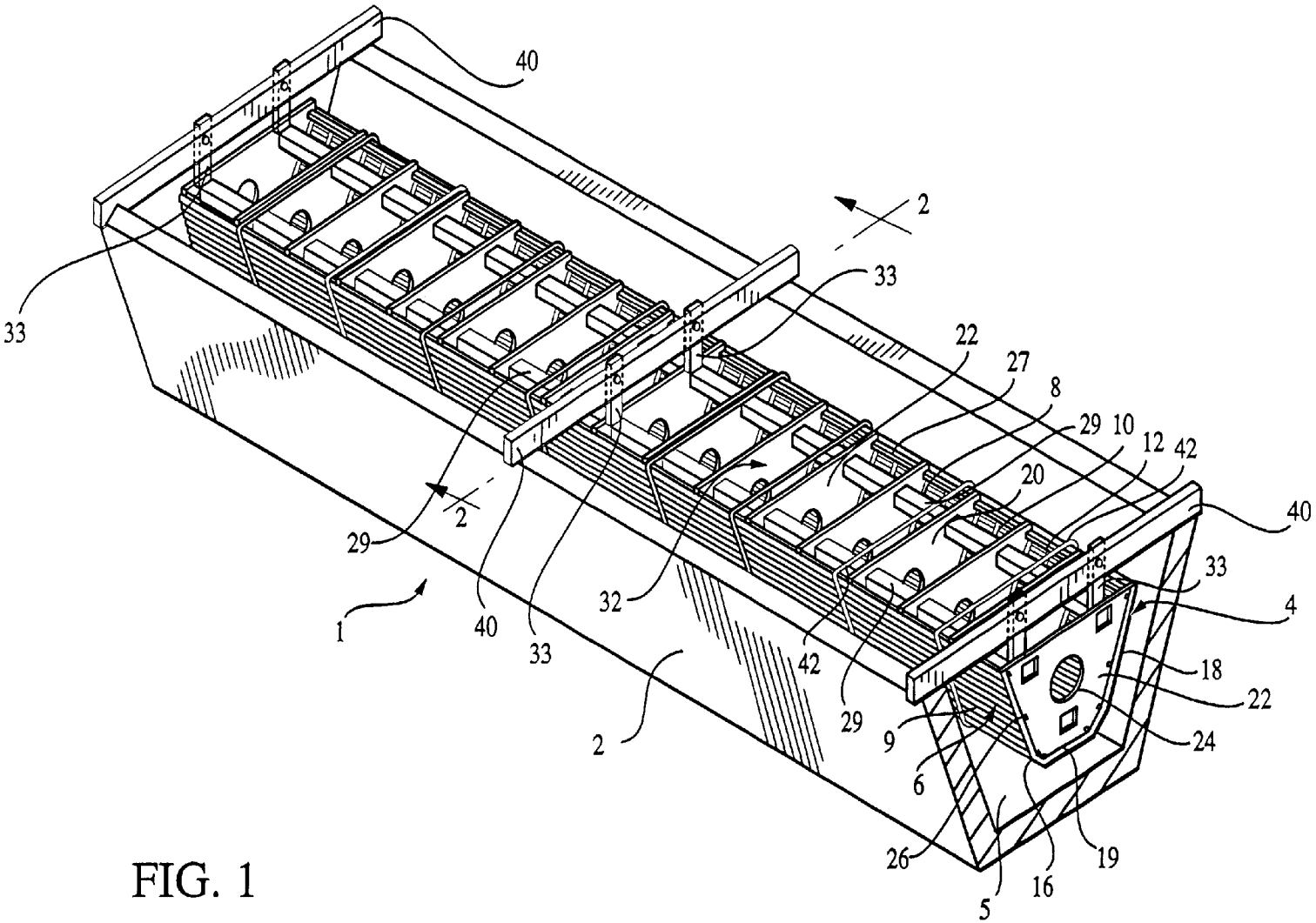
FIG. 1 is perspective view of a preferred embodiment of the invention spaced apart from an outer wall.

FIG. 1 shows a perspective view of a mold 1 that incorporates a preferred embodiment of this invention. The mold 1 includes an outer wall 2 and an inner wall or multi-part form 4 spaced apart from the outer wall 2. The inner wall 4 is made up of an exterior wall 6, an intermediate wall 10 and an interior wall 20. The outer wall 2 of the mold 1 may be an in situ formation such as concrete, stone or brick trench. The inner (upper) wall 4 of the mold 1 is positioned within the outer wall 2 such that a space 5 is defined between the inner wall 4 and the outer wall 2.

The trough or runner for holding or processing molten metal may be formed by pouring a casting compound into the space between the outer wall 2 and the inner wall 4. In a preferred embodiment the casting compound is a pumpable refractory material, such as HP-4 or HP-5 manufactured by Magneco/Metrel, Inc. and disclosed in U.S. Pat. No. 5,494,267 (Anderson et al.); U.S. Pat. No. 5,147,830 (Banerjee et al.) U.S. Pat. No. 5,511,762 (Connors, Jr. et al.); U.S. Pat. No. 5,505,893 (Connors, Jr.) and U.S. Pat. No. 5,482,248 (Connors, Jr.), which are hereby incorporated by reference.

Figure 2:
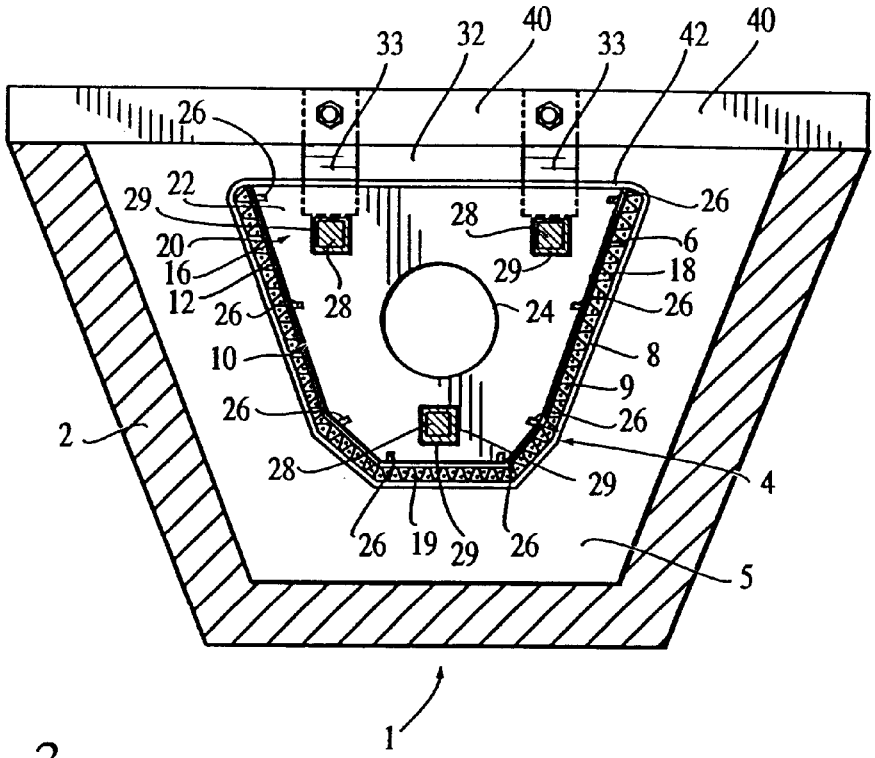
FIG. 2 is a cross-sectional view taken along 2–2' of FIG. 1.

Referring to FIG. 2, the exterior wall 6 of the inner wall 4 has an inner side 8 and an outer side 9. The exterior wall 6 is preferably an open mesh galvanized steel screen that includes a number of openings. The screen may be obtained by lancing and expanding galvanized sheet steel to form solid V-shaped ribs with expanding mesh portion with the mesh openings being the shape of parallelograms. A screen of this type is sold by Alabama Metal Industries Corp. of Birmingham, Ala. under the name "Stay-Form." Of course, other screens with similar characteristics may also be used. Screens of this type have been conventionally used as leave-in-place mold walls for concrete building construction with the screens functioning as permanent parts of the hardened concrete walls. Although the exterior wall may be removed, it is preferably consumable and will melt when molten metal is poured into the mold. Alternatively, the exterior wall may be formed from a solid metal sheet that has no openings.

Figure 8:
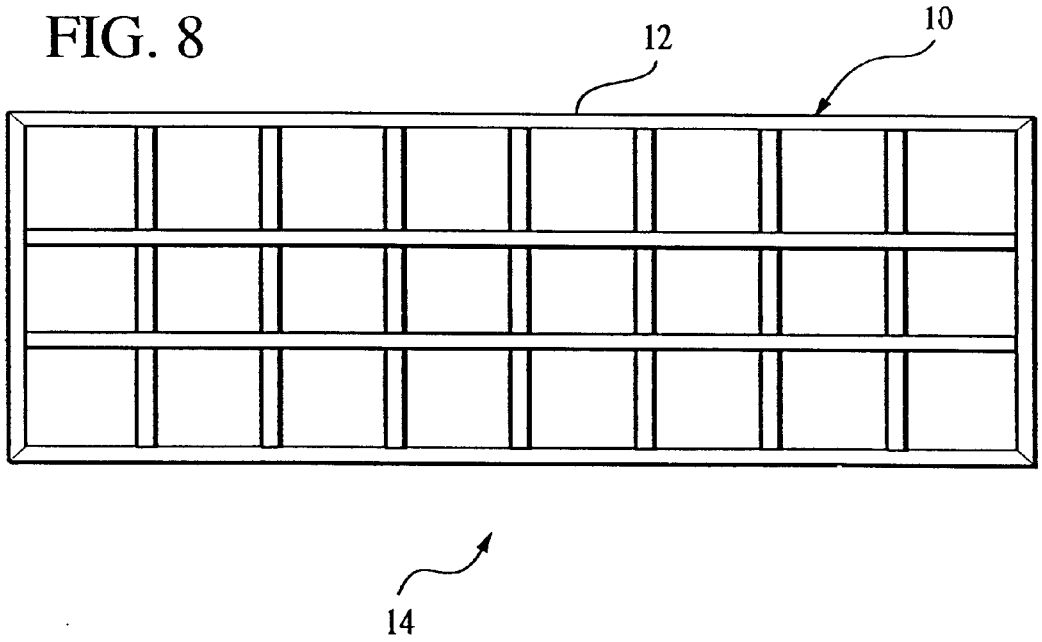
FIG. 8 is a side elevational view of a section member of the intermediate wall.

Referring to FIGS. 2 and 8, contacting the inner side 8 of the exterior wall 6 is the intermediate wall 10. The intermediate wall has a first side 16 and a second side 18 and a bottom 19. As shown in FIG. 8, each side is made of section members or sections 14 that are composed of interlaced frame members 12. The sides 16, 18 are preferably butt-welded together to the bottom 19 of the intermediate wall 10. The fact that the intermediate wall 10 is made of sections 14 and that these sections 14 are butted together permits the intermediate wall 10 to be easily folded inward.

Each section 14 is approximately eight feet in length. The number of sections 14 used to form an intermediate wall 10 is based upon the length of the mold which will vary depending upon the application. Further, alternative sizes and shapes for the sections 14 may be suitably chosen to meet a particular application. In a preferred embodiment, the frame members are box tubing 12 that are square shaped, have a size of 1 inch by 1 inch and are made of ⅛ inch thick mild steel.

Referring to FIGS. 1 and 2, the interior wall 20 is made of a series of spaced apart parallel plates 22. An opening 24 that is preferably circular in shape is cut approximately in the center of each plate 22 to reduce the weight of the plate 22. As shown in FIG. 2, perimeter openings or notches 26 are spaced apart along the outside edges of each plate 22.

In a preferred embodiment, the plates 22 are spaced approximately 12 inches apart and are approximately ¼ inches thick. In a preferred embodiment the opening 12 has a diameter of 12 inches. In alternative embodiments the diameter will vary depending on the width of the plates. The plates are preferably made of metal such as ¼" A36 structural steel. The number of plates 22 used to form the interior wall is based upon the size of the mold which varies depending upon the application. The notches 26 are preferably sized and shaped to receive connecting members 27. In a preferred embodiment the connecting members 27 are box tubing that are square shaped, have a size of 1 inch by 1 inch and are made of mild steel that is ⅛ inch thick. The notches are preferably spaced approximately 12 inches apart.

Internal openings 28 are formed in each plate 22 and are disposed around the opening 24. The internal openings 28 are shaped to receive support members 29. In a preferred embodiment the support members are box tubing that pass through the internal openings 28, are preferably square shaped in cross section and have a size of approximately 4 inches by 4 inches. The support members 29 are welded to the plates 22 and provide lateral support to the interior wall 20 and thereby generally to the inner wall 4 (i.e. they prevent the interior wall 20 from being subject to an accordion effect from front to back).

Referring to FIG. 2, a crossbeam 40 is shown. The crossbeam 40 is attached to the top 32 of the interior wall 20 using two channel members 33 that are preferably welded to the top 32 of the interior wall 20 and bolted to the crossbeam 40. The crossbeam 40 is designed to hold the inner wall 4 in position, so it does not pop out or become misaligned during the molding process. In a preferred embodiment, two crossbeams 40 are attached to every 8 foot section of the inner wall 4.

The following describes a preferred method of attaching the walls 6,10,20 together to form the multi-part form or inner wall 4. First, the series of parallel spaced-apart plates 22, including the connecting members 27 and the support members 29 that form the interior wall 20, are turned upside down from the position shown in FIG. 2. Next, the right side section 18 and left side section 16 that form the intermediate wall 10 are wrapped around the interior wall 20 and are preferably butt-welded together at the bottom point 19. Next, the exterior wall 6 is tightly wrapped around the intermediate wall 10. Finally, banding straps 42 are passed around the exterior wall 6 and the top 32 of the interior wall to secure the entire assembly. The banding straps 42 are crimped so they will not unexpectedly loosen. In an eight foot section of inner wall 4, approximately four banding straps 42 are preferably used and are spaced about 30 inches apart.

Figure 3:
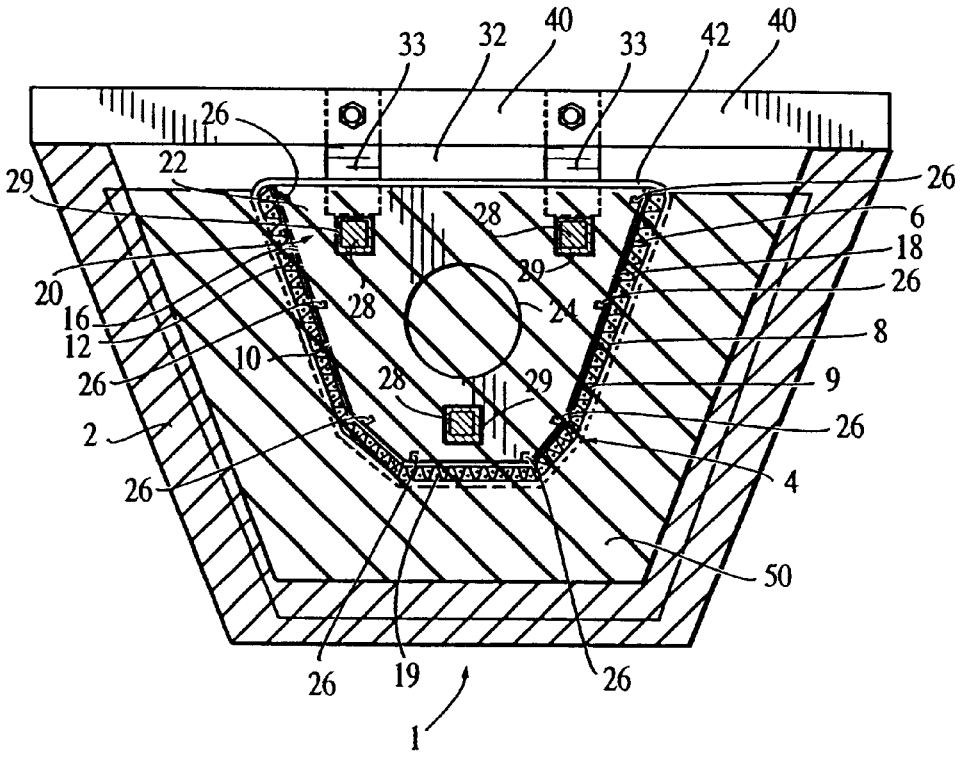
FIG. 3 is the view of FIG. 2 wherein casting compound is poured into the spare between the preferred embodiment of the invention and the outer wall.

In operation, first the inner wall 4 is lowered into the position shown in FIG. 2. Referring to FIG. 3, casting compound 50 is poured into the space 5 between the outer wall 2 and the inner wall 4.

Figure 4:
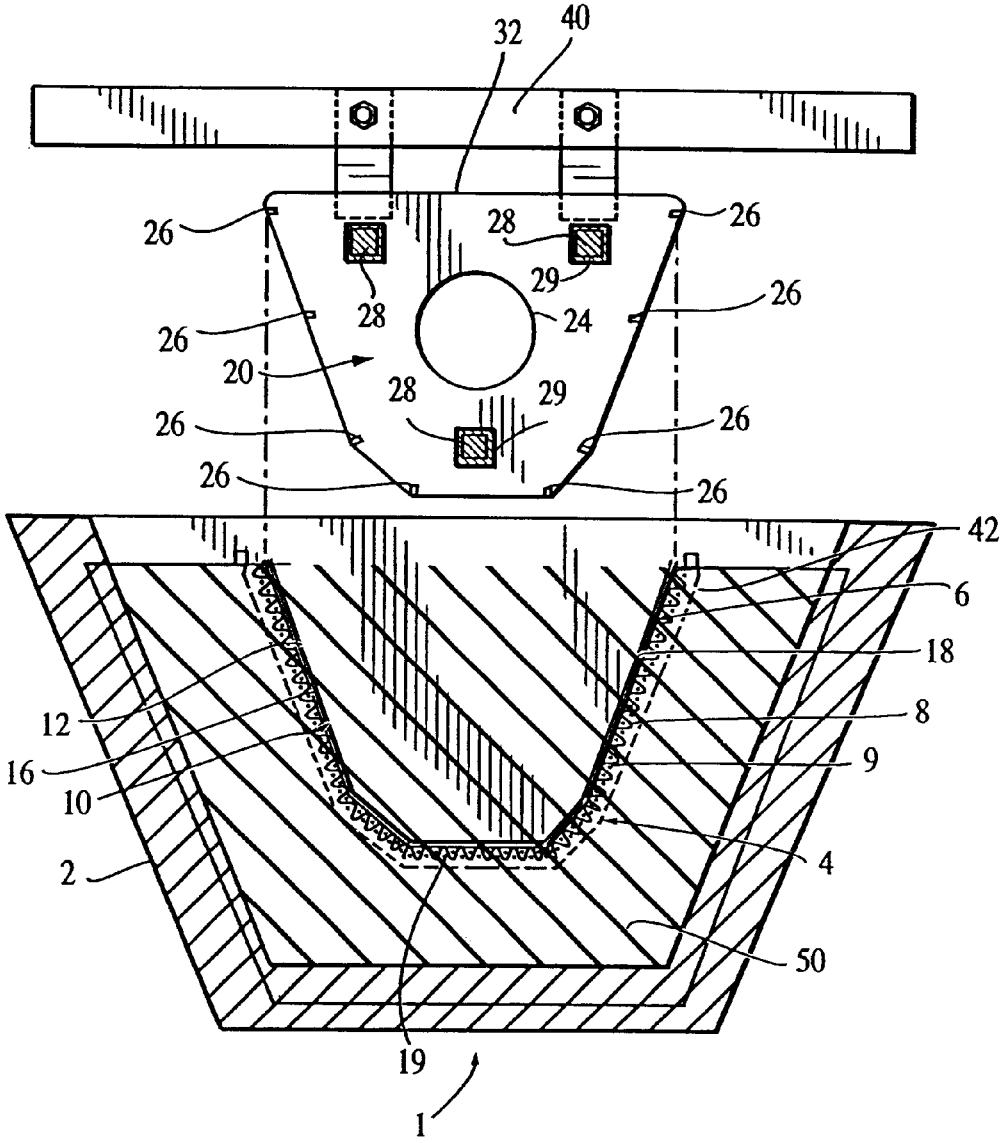
FIG. 4 is the view of FIG. 2 showing the removal of an interior wall from the preferred embodiment of the invention.

Next, as shown in FIG. 4, the interior wall 30 is removed from the inner wall 4. The interior wall 30 is preferably removed using a crane attached to the crossbeams 40. In a preferred embodiment, the interior 20 wall slides easily out of the mold 1 and moves smoothly with respect to the intermediate wall 10 because each surface is preferably made of metal. In addition, the interior wall 30 is easily withdrawn because it is not in direct contact with the casting compound 50.

Figure 5:
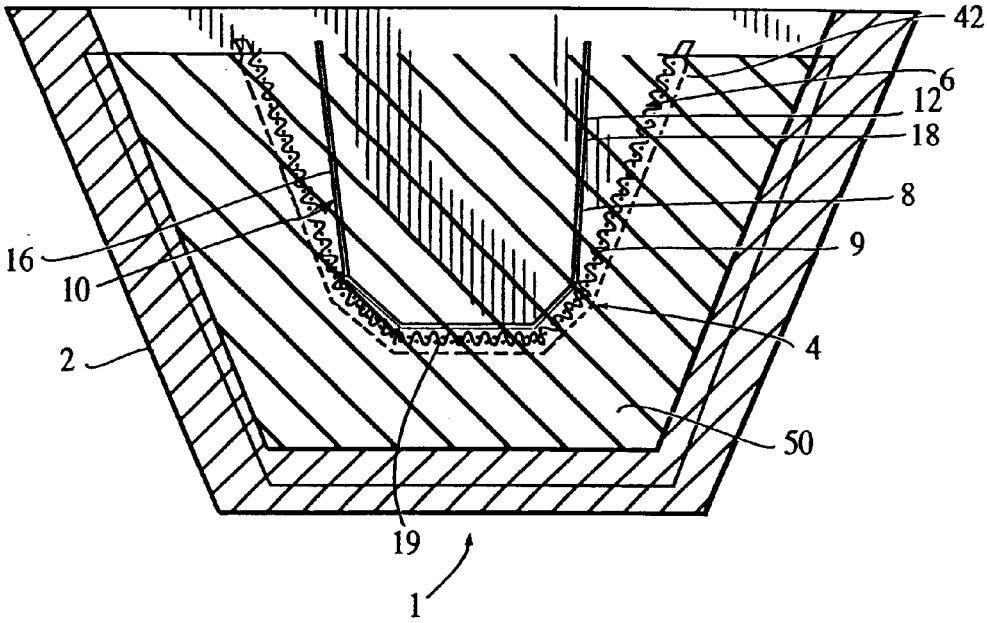
FIG. 5 is the view of FIG. 2 and shows an intermediate wall being collapsed.
Figure 6:
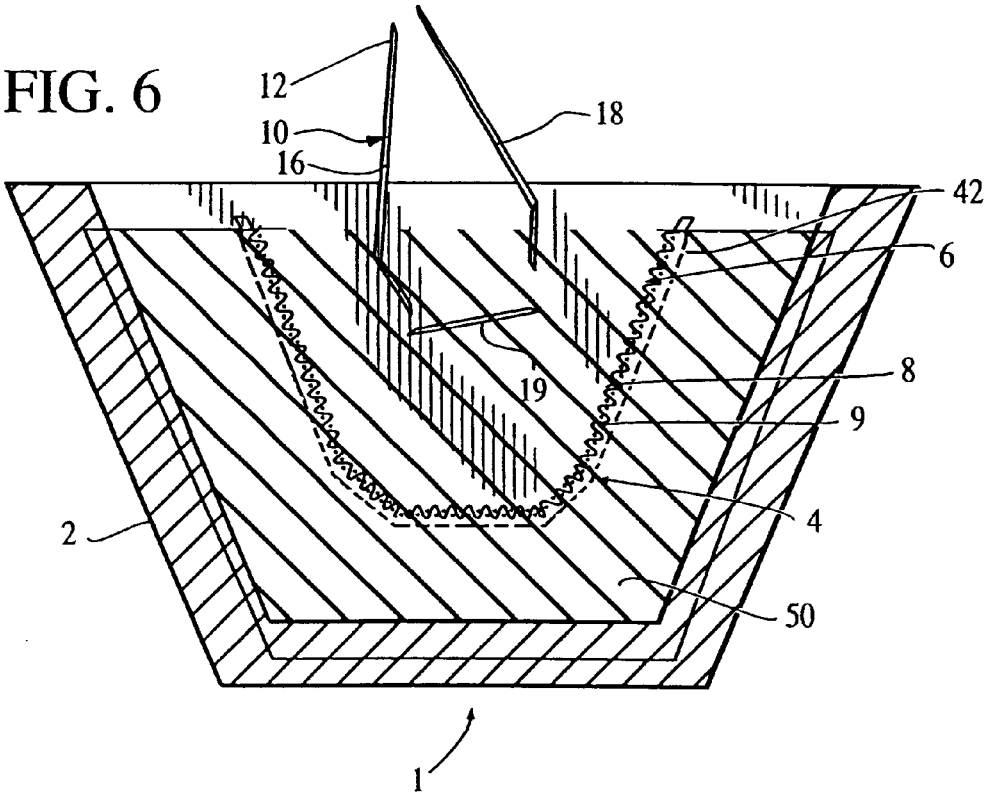
FIG. 6 is the view of FIG. 2 and shows the removal of the intermediate wall from the preferred embodiment of the invention.
Figure 7:
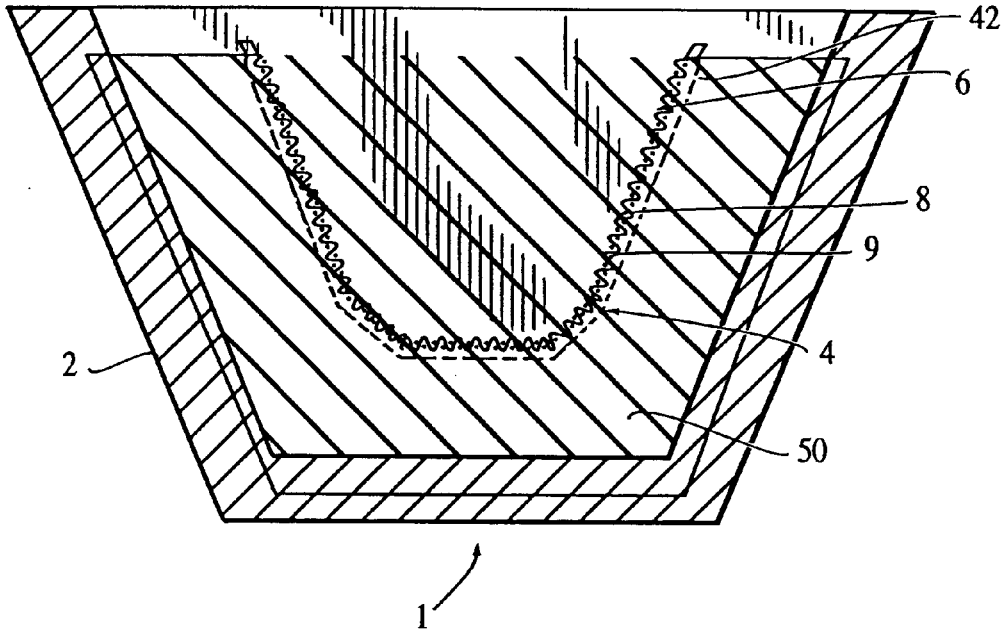
FIG. 7 is the view of FIG. 2 and shows the casting compound around an exterior wall of the preferred embodiment of the invention.

Referring to FIG. 5, after the interior wall 20 has been removed, the intermediate 10 wall is collapsed. The intermediate wall 10 is collapsed by pulling the first side 16 and the second side 18 in a horizontal direction shown in FIG. 5. The intermediate wall 10 can be pulled inward by hand or by using an overhead crane.

Next, in a preferred embodiment, the intermediate wall 10 is lifted out of the mold 1 in a vertical direction in sections. The first side 16, second side 18 and bottom 19 are removed separately. The advantage of removing the intermediate wall 10 in this sequence is that pulling inward or horizontally is an easier way to break the intermediate wall 10 away from any casting compound that may have adhered to the intermediate wall as opposed to immediately lifting the intermediate wall 10 in a vertical direction out of the mold 1.

The exterior wall 6 is preferably left in the mold 1 while the casting compound is curing. After the casting compound has cured and dried to form the containment member, molten metal may be poured into the containment member for containment or processing purposes.

One advantage of the preferred embodiment of the present invention is that the inner wall 4 may be removed with less risk of damaging the casting compound and removed faster than past inner forms. Immediately after the casting compound is poured, it is fragile until it cures or sets. When the interior wall 20 is removed, it slides against the intermediate wall 10 and therefore does not pull out or break any of the casting compound. Further, the intermediate wall 10 is collapsed horizontally and then removed, thereby decreasing the chance that any refractory material will be damaged. Also, these advantages allow the form to be removed faster than previous forms, which is significant because the longer it takes to remove a form, the longer the trough or runner is out of service, and while the trough is out of service, the furnace is out of service, which can be costly.

Another advantage of the preferred embodiment of the present invention is that the exterior wall which is preferably Stay-Form, may be left in the mold to permit venting of moisture from the drying casting compound 50.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. A multi-part form of a mold for forming a containment member for molten metal, comprising:

a consumable exterior wall;

a collapsible intermediate wall connected to an inner side of the exterior wall; and an interior wall slidably engaged to the intermediate wall.

2. The multi-part form of claim 1, wherein the intermediate wall comprises a plurality of section members.

3. The multi-part form of claim 2, wherein the section members have a right side portion and a left side portion.

4. The multi-part form of claim 2, wherein the section members comprise a plurality of frame members welded together.

5. The multi-part form of claim 4, wherein the frame members are square shaped in cross section.

6. The multi-part form of claim 1, wherein the interior wall comprises a plurality of spaced apart plates oriented parallel to one another.

7. The multi-part form of claim 6, wherein the plates have a plurality of openings.

8. The multi-part form of claim 7, wherein the plates are interconnected with connecting members received in the openings.

9. The multi-part form of claim 6, wherein the plates have a plurality of internal openings.

10. The multi-part form of claim 9, wherein support members are passed through the internal openings to provide lateral support to the interior wall.

11. A mold for forming a containment member for molten metal, comprising:

an inner wall comprising, a consumable exterior wall, a collapsible intermediate wall substantially surrounded by the exterior wall, the collapsible intermediate wall comprising a plurality of frame members welded together, and an interior wall slidably engaged to the intermediate wall, the interior wall comprising a plurality of spaced apart plates interconnected with a plurality of connecting members; and an outer wall disposed to substantially surround the inner wall and to define a space between the outer wall and the inner wall, the space to form the containment member from a casting compound.

12. The mold of claim 11 wherein the plates have a plurality of openings and the connecting members are received in the openings.

13. The mold of claim 11, wherein the plates have a plurality of internal openings.

14. The mold of claim 13, further comprising support members passed through the internal openings and connected to the interior wall, the support members to provide lateral support to the interior wall.

15. The mold of claim 11, wherein the exterior wall is an open meshed galvanized steel screen.

* * * * *